US006249255B1

(12) United States Patent
Eggleston

(10) Patent No.: US 6,249,255 B1
(45) Date of Patent: Jun. 19, 2001

(54) ANTENNA ASSEMBLY, AND ASSOCIATED METHOD, HAVING PARASITIC ELEMENT FOR ALTERING ANTENNA PATTERN CHARACTERISTICS

(75) Inventor: Steve Eggleston, San Diego, CA (US)

(73) Assignee: Nokia Mobile Phones, Limited, Espoo (FI)

( * ) Notice: Subject to any disclaimer, the term of this patent is extended or adjusted under 35 U.S.C. 154(b) by 0 days.

(21) Appl. No.: 09/302,772

(22) Filed: Apr. 30, 1999

(51) Int. Cl.[7] ..... H01Q 1/24
(52) U.S. Cl. ..... 343/702; 343/895
(58) Field of Search ..... 343/702, 895, 343/873; 455/90; H01Q 1/24

(56) References Cited

U.S. PATENT DOCUMENTS 5,298,910 * 3/1994 Takei et al. ..... 343/895
5,507,012 * 4/1996 Luxon et al. ..... 343/702
5,666,125 * 9/1997 Luxon et al. ..... 343/702
5,828,342 * 10/1998 Hayes et al. ..... 343/702
5,907,307 * 5/1999 Bickert et al. ..... 343/895
5,999,142 * 12/1999 Jang ..... 343/895

* cited by examiner

*Primary Examiner*—Hoanganh Le
(74) *Attorney, Agent, or Firm*—Milan I. Patel, Esq

(57) ABSTRACT

An antenna assembly, and an associated method, for a mobile phone operable in a cellular, or other radio, communication system. The antenna assembly causes shifting of an antenna beam pattern exhibited by an antenna transducer to cause formation of the resultant antenna beam pattern which is of a configuration better to facilitate the effectuation of communications with the mobile phone.

9 Claims, 6 Drawing Sheets

DRIVEN ELEMENT

ANTENNA ASSEMBLY, AND ASSOCIATED METHOD, HAVING PARASITIC ELEMENT FOR ALTERING ANTENNA PATTERN CHARACTERISTICS

The present invention relates generally to antenna apparatus used to transduce radio frequency signals, such as the radio frequency signals generated by, or received at, a mobile phone operable in a cellular or other radio communication system. More particularly, the present invention relates to an antenna assembly, and an associated method, which utilizes a director operable to shift the antenna pattern of an antenna element. Through appropriate positioning of the director relative to an antenna transducer, better and more efficient transmission and reception of radio signals with a remote location is facilitated.

BACKGROUND OF THE INVENTION

Advancements in communication technologies have permitted the implementation, and widespread usage, of multi-user radio communication systems. A cellular communication system is exemplary of such a radio communication system. Information signals generated during operation of the radio communication system are transmitted upon radio communication channels defined upon portions of the electromagnetic spectrum. Regulatory bodies allocate portions of the electromagnetic spectrum for communications in various communication systems.

To convert the information signal into a form to permit its communication upon a communication channel defined in a radio communication system, a transmitting station modulates the information signal upon a carrier wave of a carrier frequency within the range of frequencies which defines, at least in part, the communication channel. Through such modulation process, a base band-level signal of which the information signal is formed is converted into a radio frequency signal of desired frequency characteristics.

A transmitter, operable to transmit radio frequency signals upon a radio channel, typically includes one or more up-mixing stages at which the base band information signal is up-converted in frequency to be of the selected radio frequency. The mixing stages include mixer circuits coupled to receive the information signal and an up-mixing signal with which the information signal is to be multiplied, or otherwise combined to form an up-converted signal. When multiple mixing stages are utilized, an IF (intermediate frequency) signal is formed at a first, or first series of, mixer stages. A radio frequency signal is formed at the final mixing stage.

A receiver which receives a radio-frequency communication signal transmitted thereto upon a radio communication channel must, analogously, convert the radio frequency signal to a base band level. One or more down-conversion stages is utilized to down-convert the radio frequency signal to a base band-level.

Both the transmitter and the receiver include, typically, an antenna transducer. The antenna transducer, when coupled to a transmitter to form a portion thereof, transduces the radio frequency signal generated at the transmitter out of electrical form and into electromagnetic form for transmission upon the radio channel. The antenna transducer, when coupled to a receiver to form a portion thereof, conversely, transduces radio frequency signals out of electromagnetic form and into electrical form for processing by the circuitry of the receiver.

A radio transceiver, having both a transmitter and a receiver to permit two-way communications, sometimes utilizes an antenna transducer which is shared by both the receiver and transmitter portions of the transceiver. A filter duplexer is sometimes utilized if the radio transceiver is operable pursuant to a frequency division multiplexing scheme having separate transmit and receive pass bands.

Antenna transducers coupled to radio transmitters, receivers, or transceivers are constructed to be caused to exhibit selected antenna patterns which are representative of antenna gain characteristics. Such antenna patterns typically include one or more antenna lobes which form omnidirectional or highly-directional antenna patterns. Selection of the configuration of the one or more antenna lobes is made to best facilitate transmission or reception, as appropriate, of the radio frequency signals communicated during operation of the device to which the antenna transducer is coupled.

In a cellular communication system in which portable, mobile phones are utilized by a user to effectuate telephonic communications, both power and size considerations are significant factors which make difficult antenna design for such mobile phones. And, because mobile phones are typically constructed to be operated in manners analogous to that by which a conventional, telephonic handset is positioned, portions of the antenna pattern exhibited by the antenna transducer of the mobile phone is positioned upon a portion of the user's body. Such overlapping is unproductive use of the energy which defines the antenna pattern.

If a manner could be provided by which to shift the antenna pattern exhibited by the antenna transducer so that an increased portion of the energy which defines the antenna pattern would be available for transceiving communication signals, improved radio performance would result.

It is in light of this background information related to antenna apparatus that the significant improvements of the present invention have evolved.

SUMMARY OF THE INVENTION

The present invention, accordingly, advantageously provides an antenna assembly, and an associated method, which forms a resultant antenna pattern to facilitate better and more efficient communication of radio signals generated during operation of a radio communication system.

In one aspect of the present invention, an antenna assembly is provided for a mobile phone operable in a cellular, or other radio, communication system. The antenna assembly includes an antenna active element and a director element (a parasitic element), for shifting the antenna pattern of the antenna active element to cause the antenna assembly to exhibit a resultant antenna pattern. The director element is positioned at a spaced-apart location from the antenna (within the antenna assembly) in a desired orientation relative to the antenna active element so that the antenna pattern exhibited by the antenna active element is shifted in a desired manner. By causing appropriate shifting of the antenna pattern, improved radio performance of the mobile phone is facilitated.

In such an implementation, the mobile phone is provided with an antenna assembly which exhibits antenna gain characteristics permitting operation of the mobile phone over a range of operating environments. The antenna assembly provides sufficient antenna performance to prevent noticeable signal fading when the phone is placed in a variety of positions during use of the mobile phone. And, the antenna assembly is of small dimensions, light weight, and easy to manufacture. Thereby, the antenna assembly is particularly amenable to form portions of portable mobile phones which must be of increasingly portable dimensions and of increasingly less costly constructions.

In one implementation, the antenna active element is formed of a meander line antenna device, coupled to the radio transceiver circuitry of the mobile phone. The meander lines which form the antenna active element are printed on a substrate which, in one implementation, is formed of a flexible, non-conductive material. In an implementation in which the mobile phone forms a dual-mode device, separate meander lines of dimensions suitable for the separate communication systems in which the mobile phone is operable are printed on the substrate.

The director element, in one implementation, is formed of a longitudinally-extending rod member which is spaced-apart from the meandering line in the direction in which the antenna pattern is to be shifted. Appropriate positioning of the rod member at a selected distance from the meandering line antenna active element and appropriate positioning of the rod member in a desired orientation relative to the meandering line antenna active element causes a resultant antenna pattern to be exhibited by the antenna assembly formed of the antenna active element and the director element.

By shifting the antenna pattern, increased portions of the antenna pattern can be used to facilitate the effectuation of communications between the mobile phone and the network infrastructure of the radio communication system without interference from the user's head.

In one implementation, after the meandering line is printed upon the flexible substrate, the substrate is mounted upon a cylindrical member to be wrapped about a portion of the circumference of the cylindrical member. The rod member forming the director element is also affixed to the cylindrical member. The rod member is spaced-apart from the location at which the substrate upon which the meandering lines are printed is affixed to the cylindrical member, but is still within the boundaries of the cylindrical member. Appropriate selection of the dimensions of the cylindrical member assures that the desired relationship between the rod member and the meandering lines of the antenna active element are readily maintained. Also, manufactureability of the antenna assembly is simplified and permitting of automated assembly. Because of the close proximity of the director element to the antenna active element, size constraints imposed upon the antenna assembly due to the small size of a portable mobile phone are also achieved.

In these and other aspects, therefore, an antenna assembly and an associated method, is provided for transducing radio signals at a radio device having radio circuitry operable by a user to communicate signals. A first antenna element is positioned at the radio housing and is connected to the radio circuitry. The first antenna element exhibits, in isolation, a first antenna pattern, and is operable to transduce radio signals. A second antenna element is positioned at the radio housing and is spaced-apart from the first antenna element to be positioned in the selected relationship therewith. The second antenna element alters the first antenna pattern in a manner responsive to positioning of the second antenna element in the selected relationship with the first antenna element. Thereby, a second antenna element causes the first antenna element to exhibit a resultant antenna pattern, the resultant antenna pattern being non-identical with the first antenna pattern.

A more complete appreciation of the present invention and the scope thereof can be obtained from the accompanying drawings which are briefly summarized below, the following detailed description of the presently-preferred embodiments of the present invention, and the appended claims.

DETAILED DESCRIPTION OF THE PREFERRED EMBODIMENT

Figure 1:
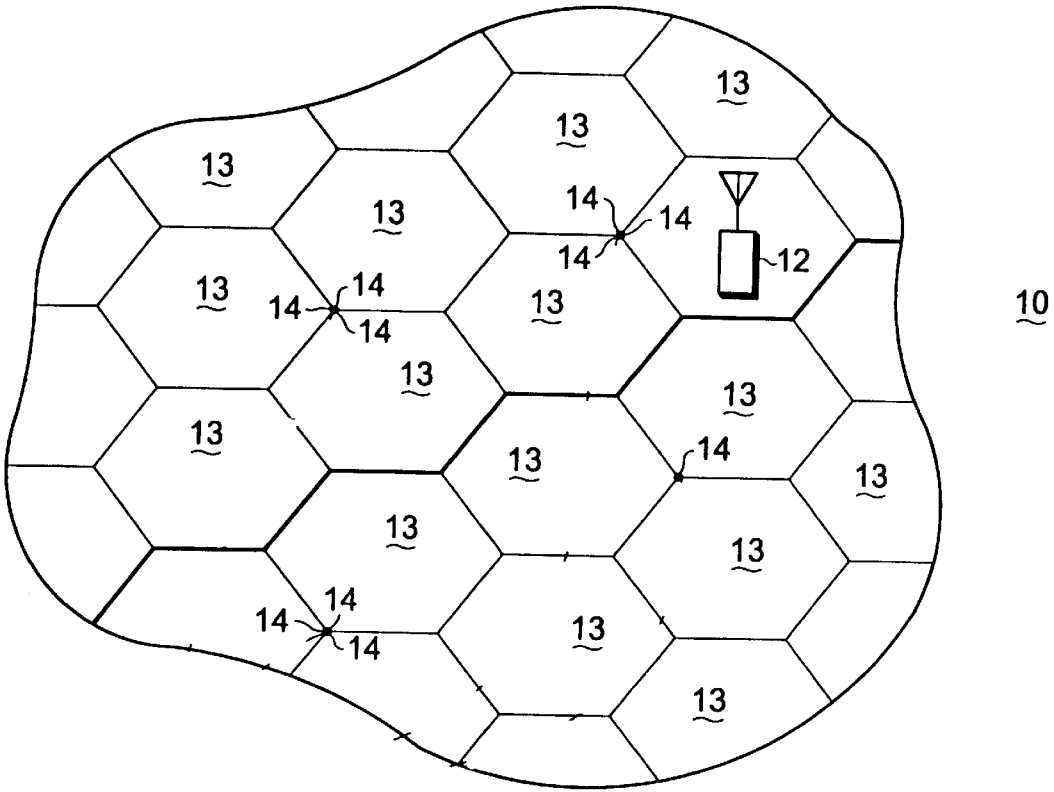
FIG. 1 illustrates a representation of a portion of a cellular communication system in which an embodiment of the present invention is operable.

Referring first to FIG. 1, a portion of a cellular communication system, shown generally at 10, provides for wireless communications with mobile phones through which a user is able to communicate telephonically. An exemplary mobile phone 12 is shown in the Figure. In an exemplary implementation, an embodiment of the present invention forms a portion of the mobile phone 12. It should be understood, of course, that an embodiment of the present invention can analogously form portions of other radio devices.

Cells 13 are defined in a cellular communication system by radio base stations 14. A cell is a portion of the geographical area encompassed by the cellular communication system 10 and within which communications between a mobile phone and a radio base station which defines such cell generally can be effectuated. In the exemplary system in which sets of three radio base stations are co-located, each radio base station defines a sector cell in conventional manner.

Operation of an embodiment of the present invention facilitates the effectuation of radio communications between a mobile phone 12 and a radio base station 14. That is to say, improved communication of forward link signals transmitted by a radio base station 14 to a mobile phone 12 and also of reverse link signals generated by a mobile phone 12 for communication to the radio base station 14 is provided by an embodiment of the present invention.

Figure 2:
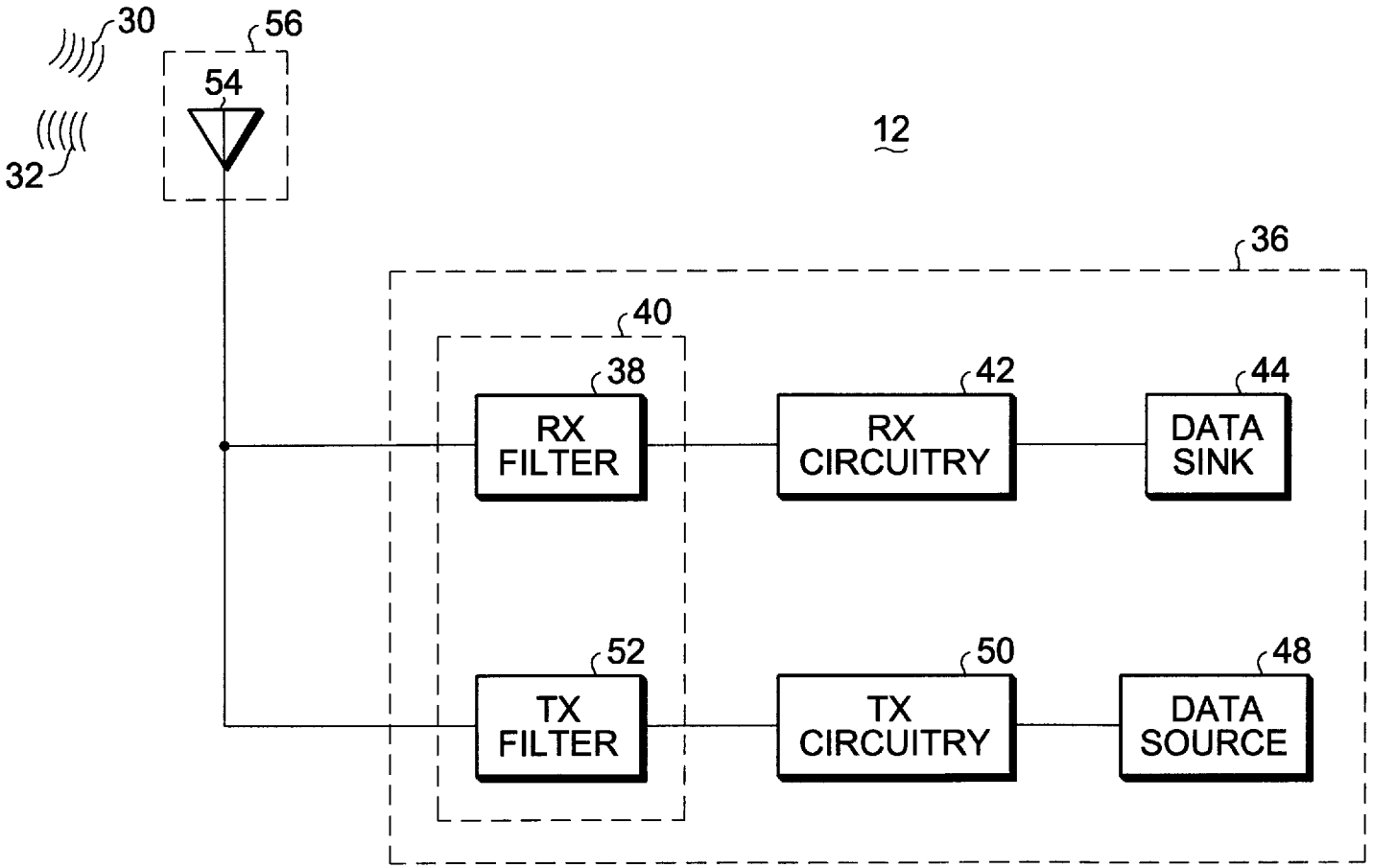
FIG. 2 illustrates a functional block diagram of a mobile phone which includes an embodiment of the present invention as a portion thereof and which is operable in the cellular communication system shown in FIG. 1.

FIG. 2 illustrates again the mobile phone 12 which includes an embodiment of the present invention as a portion thereof. The mobile phone 12 includes transceiver circuitry 36, thereby to permit two-way communication between the mobile phone and the radio base station. The transceiver circuitry 36 includes a receiver portion having a receive path including a receive filter portion 38 of a filter duplexer 40 receiver circuitry which includes, for instance, down-conversion and demodulation circuitry 42, and a data sink 44. The transceiver 36 further includes a transmitter portion having a transmit path including a data source 48, transmitting circuitry 50 including, for instance, modulation and up-conversion circuitry, and a transmit filter portion 52 of the filter duplexer 40.

Both portions 38 and 52 of the filter duplexer 40 are coupled to an antenna transducer 54 forming an antenna active element. The antenna transducer forms a portion of an antenna assembly 56 of an embodiment of the present invention. The antenna assembly 56 is operable to transduce forward link signals 30 from electromagnetic form to electrical form and to provide such signals to the receiver portion of the transceiver circuitry 36. The antenna assembly 56 is further operable to transduce radio frequency, electrical signals generated by the transmitter portion of the transceiver circuitry into electromagnetic form, thereby to form the reverse link signals 32. As shall be explained more fully below, the antenna assembly 56 facilitates effectuation of communication by causing the antenna assembly to form a resultant antenna beam pattern which facilitates such communication.

Figure 3:
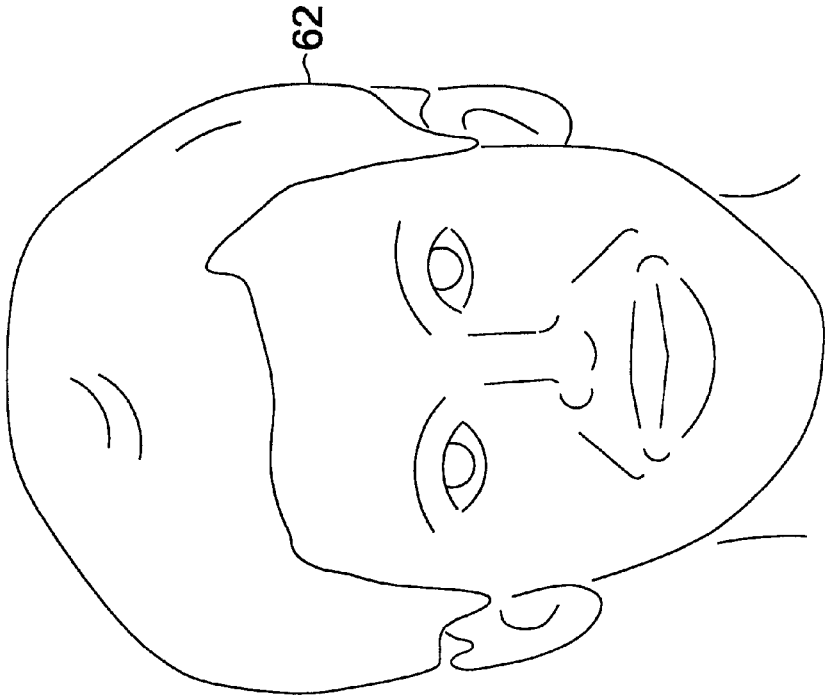
FIG. 3 illustrates a partial schematic, partial block diagram of the mobile phone shown in FIG. 2, here proximate to a user of the mobile phone.
Figure 3:
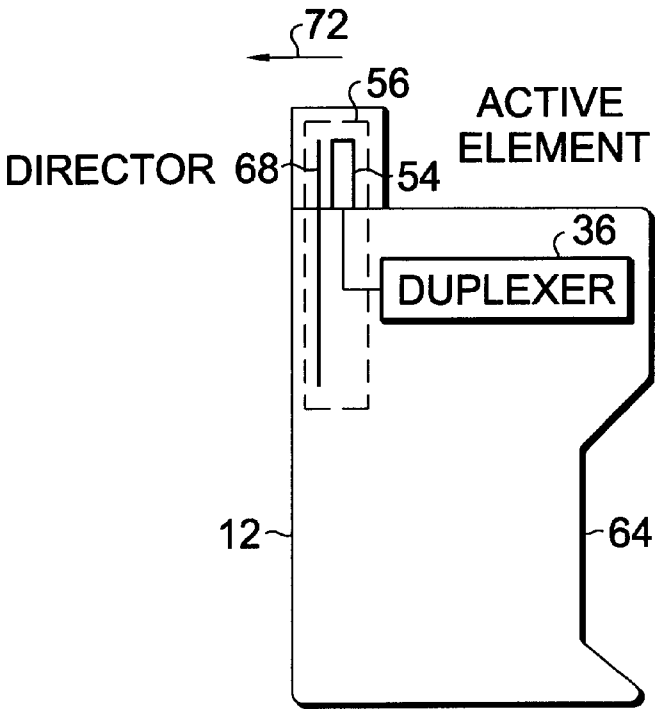

FIG. 3 again illustrates the mobile phone 12, shown previously in FIGS. 1 and 2. The mobile phone 12 is here positioned proximate to a user 62 in a position conventionally utilized by a user when the mobile phone is operated by the user to communicate telephonically. The mobile phone 12 is here shown to include a handset housing 64 which houses the transceiver circuitry 36 to support such circuitry 36 thereat. While not separately shown, in conventional manner, the handset housing 64 supports a speaker portion and a microphone portion at opposing ends of the housing so that, when the user 62 positions the mobile phone 12 to communicate telephonically there through, the speaker portion is positioned proximate to an ear of the user, and the microphone is positioned proximate to the mouth of the user.

The transceiver circuitry 36 is again shown to be connected to the activ antenna element formed of the antenna transducer 54 of the antenna assembly 56. The antenna element 54 here forms a stub antenna which forms a radiating element when reverse link signals are generated by the transmitter portion of the transceiver circuitry.

The antenna assembly 56 is here shown to further include a director element 68. In the exemplary implementation, the director element is formed of an electrically-conductive rod member which is spaced-apart from the antenna transducer 54 at a selected distance and in a selected orientation thereto. The director element functions as a parasitic element and is operable to cause a shifting of the antenna pattern in a direction indicated by the arrow 72 in FIG. 2. That is to say, in isolation, the active antenna element formed of the antenna transducer 54 exhibits an antenna pattern of first characteristics, and the positioning of the director element 68 in the manner as-illustrated causes shifting of the antenna beam pattern in the direction of the arrow 72 to form a resultant antenna pattern. By shifting the antenna beam pattern in the direction of the arrow 72, increased levels of transmitted energy of a reverse link signal generated by the transmitter portion of the transceiver circuitry is used to facilitate transmission of the reverse link signal to a radio base station. Lessened amounts of the antenna beam pattern overlaps upon the user. Thereby increased portions of the antenna energy contributes to the communication of the reverse link signal to the radio base station.

Figure 4:
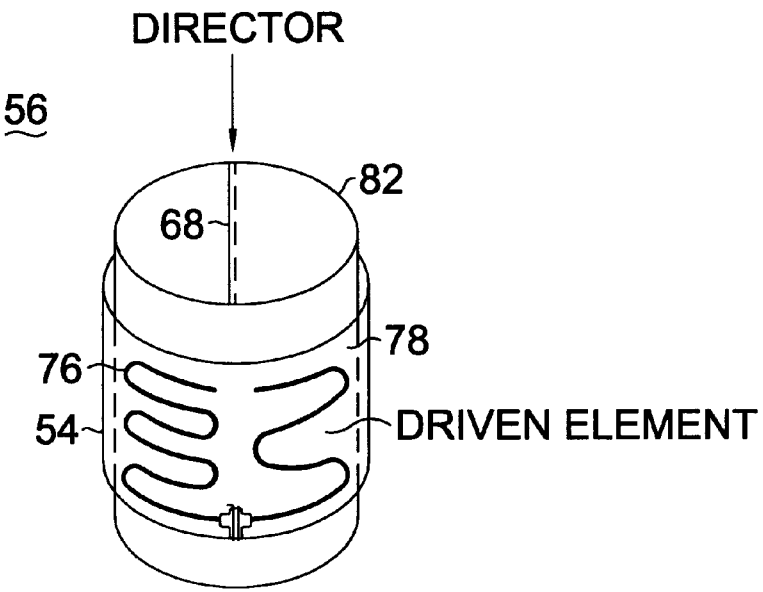
FIG. 4 illustrates, in isolation, an antenna assembly of an embodiment of the present invention.

FIG. 4 illustrates the antenna assembly 56 of an exemplary embodiment of the present invention. The assembly is again shown to include the active antenna element formed of the antenna transducer 54 and the director element 68. The antenna transducer 54 is here shown to be formed of a meandering line antenna having a serpentine-like conductive path 76 printed upon a flexible, non-conductive substrate 78. The substrate 78 is wrapped about a portion of the circumference of a non-conductive cylinder 82 and affixed thereto by way of an adhesive material, or the like. The director element 68 is also fixed to the non-conductive cylinder 82. The director element 68 is spaced-apart from the active antenna element formed of the antenna transducer 54 by its positioning at a side of the cylinder 82 opposed to the position at which the antenna transducer 54 is affixed to the cylinder. Thereby, by affixing both the active element antenna and the director element at the cylinder 82, the director element 68 is caused to be positioned at a selected distance defined by the diameter of the cylinder and maintained in a desired orientation relative to the active antenna element.

In one implementation, a longitudinally-extending groove is formed into the surface of the cylinder 82, thereby to facilitate positioning of the director element to extend therealong. In the exemplary implementation, the rod member which forms the director element 68 is of a length corresponding to that of less than a half-wave dipole (e.g., 55 to 65 mm). When the mobile phone (shown in FIGS. 1–3) of which the antenna assembly 56 forms a portion is operable in a conventional, AMPS (advanced mobile phone service) or PCS (personal communication system), cellular system, the diameter of the cylinder 82 is of 4–5 millimeters. The impedance of the active antenna element formed of the antenna transducer 54 is easily constructed to be of approximately 50 ohms which indicates that the mutual coupling between elements is not excessive. The director element 68 is positioned in a direction to extend parallel to the electrical axis of the antenna transducer 54.

Figure 5:
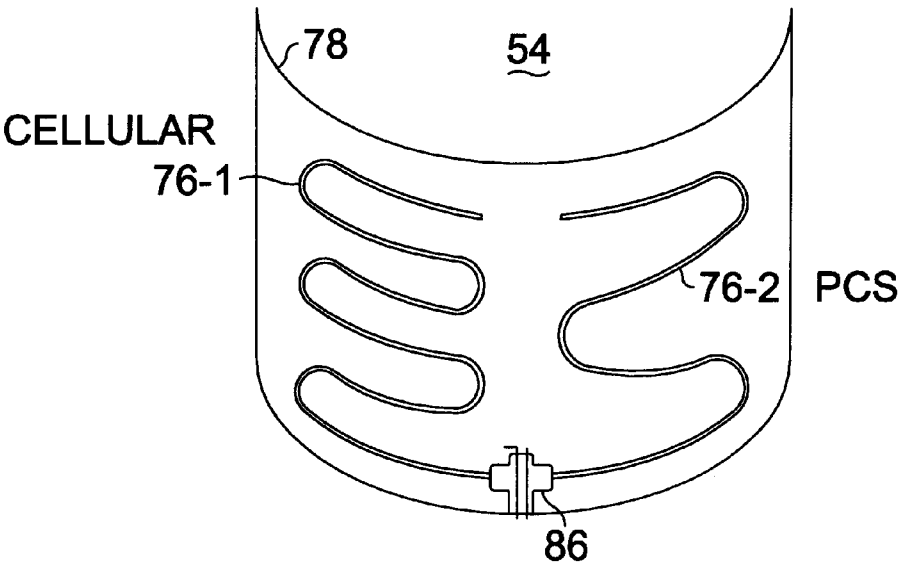
FIG. 5 illustrates a portion of the antenna assembly shown in FIG. 4.

FIG. 5 illustrates the active antenna element formed of the antenna transducer 54 in the exemplary implementation and again is shown to be formed of a serpentine-shaped, conductive tab 76 printed upon a flexible substrate 78. In the implementation illustrated in the Figure, the antenna transducer 54 is constructed to be operable in a dual-mode, mobile phone, operable pursuant to an AMPS standard and operable pursuant to a PCS standard which, in conventional manner, is operable at separate frequency ranges. A first conductive path 76-1 is printed on a left-side (as shown) portion of the substrate, and a second conductive path 76-2 is printed at a right-side (as shown) portion of the substrate. The conductive path 76-1 is of dimensions to facilitate transducing of radio signals of frequencies corresponding to signals generated in an AMPS system, and the conductive path 76-2 is of a length to facilitate transducing of radio signals generated during operation of a PCS system. A conductive tab 86 is formed on the substrate 78 and provides a connecting pad to which a connector (not shown) can be affixed to connect the active antenna element to the transceiver circuitry 36 (shown in FIGS. 2–3) of the mobile phone.

Figure 6:
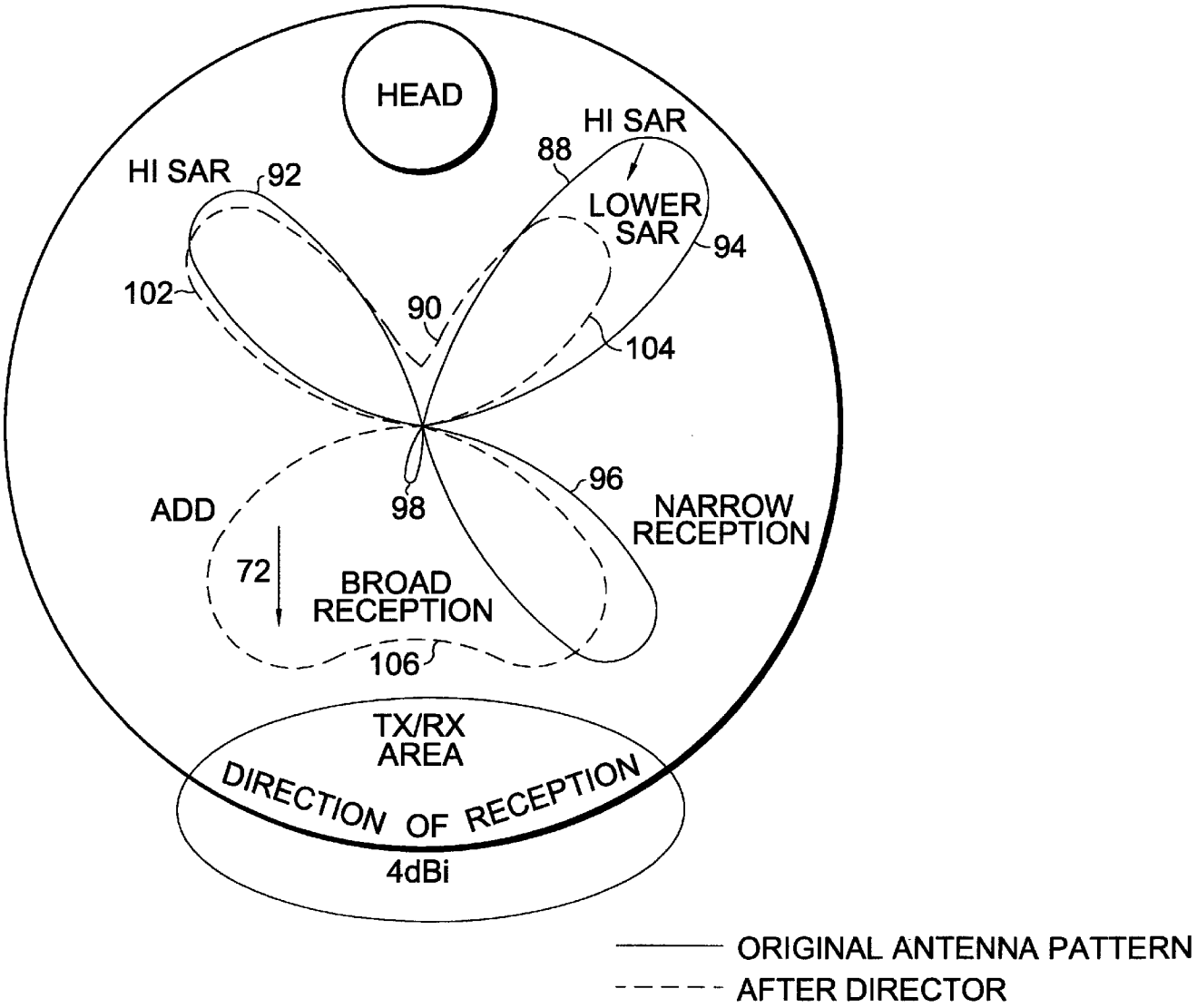
FIG. 6 illustrates an exemplary resultant antenna pattern formed during operation of an embodiment of the present invention, together with a corresponding antenna pattern of conventional configuration.

FIG. 6 illustrates a first antenna beam pattern 88 and a resultant antenna beam pattern 90. The antenna beam pattern in 88 is representative of the antenna gain of the antenna transducer 54 shown in FIGS. 2–5 in isolation, viz., when the active antenna element is positioned in the absence of the director element 68. And, the resultant antenna pattern 90 is representative of the antenna gain exhibited by the antenna assembly 56, viz., the antenna transducer formed of the active antenna element together with the director element. As shown, the antenna pattern 88 includes three primary lobes 92, 94, and 96, along with a lobe 98 of reduced dimensions. Positioning of the director element to form a portion of the antenna assembly causes the resultant antenna pattern 90 to be shifted in the direction of the director element and also to alter the configuration of the lobes 92–98 of the antenna pattern 88. As illustrated, the lobes 102 and

104, corresponding to the lobes 92 and 94, are of reduced energy levels. And, a lobe 106 corresponding to the lobes 96 and 98 is of increased dimensions to facilitate broad reception and transmission of radio signals.

Figure 7:
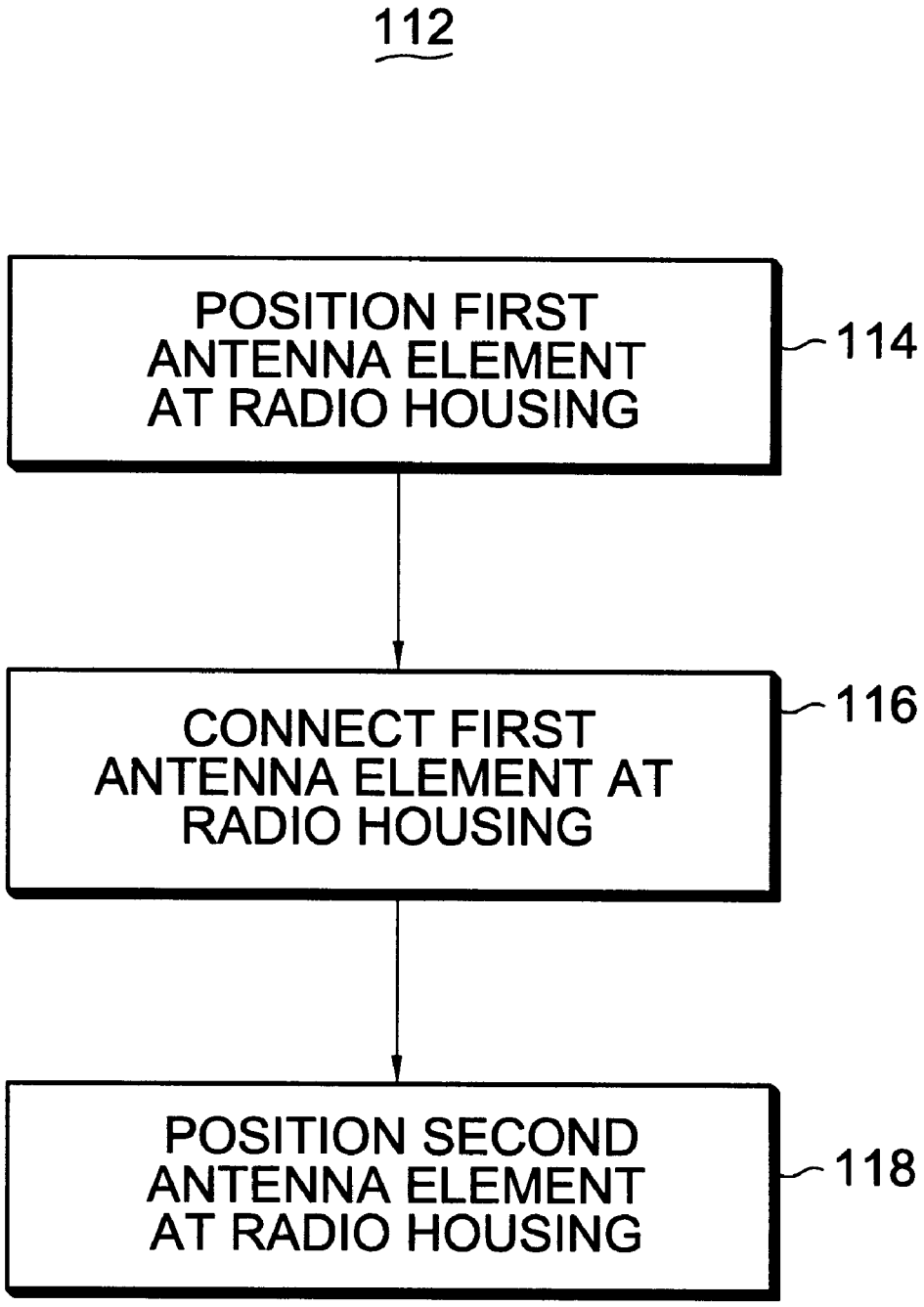
FIG. 7 illustrates a method flow diagram listing the method steps of the method of operation of an embodiment of the present invention.

FIG. 7 illustrates a method flow diagram of a method, shown generally at 112, of an embodiment of the present invention. The method 112 transduces radio signals at a radio device having radio circuitry operable by user. The radio circuitry is housed at a radio housing carriable by the user.

First, and as indicated by the block 114, a first antenna element is positioned at the radio housing. Then, and as indicated by the block 116, the first antenna element is connected to the radio circuitry housed at the radio housing. The first antenna element exhibits, in isolation, a first antenna pattern such as 88 of FIG. 6.

Then, and as indicated by the block 118, a second antenna element is positioned at the radio housing. The second antenna element is spaced-apart from the first antenna element to be in a selected relationship with the first antenna element. Positioning of the second antenna element to be in the selected relationship with the first antenna element causes alteration of the first antenna pattern to form a resultant antenna pattern such as 90 of FIG. 6. The resultant antenna pattern is non-identical with the first antenna pattern.

Thereby, a manner is provided by which to facilitate better transmission and reception of radio signals at a remote location by causing appropriate shifting of the antenna pattern exhibited by an active antenna element formed of an antenna transducer. An antenna assembly includes, in addition to the antenna transducer, a director element. The director element is positioned relative to the active antenna element, in the direction in which the antenna gain is to be increased. The resultant antenna gain is increased in such direction, thereby to improve performance of radio communication and while also reducing the antenna gain in opposing direction. An antenna assembly of compact dimensions is provided. In one implementation, the driven element, i.e., the active antenna element formed of an antenna transducer is separated from the director element by only 4 mm, about 0.013 wavelengths at cellular frequencies.

The previous descriptions are of preferred examples for implementing the invention, and the scope of the invention should not necessarily be limited by this description. The scope of the present invention is defined by the following claims:

What is claimed is:

1. In a radio device having radio circuitry operable by a user to transmit and receive radio signals, the radio circuitry housed by a radio housing that is carriable by a user with said radio housing generally adjacent to the user, an antenna assembly for transducing the radio signals, said antenna assembly comprising:

an active antenna element positioned at the radio housing and electrically connected to said radio circuitry; said active antenna element comprises conductive paths that are printed upon a substrate; said substrate comprises a cylinder having said conductive paths only on a limited diametric portion of said cylinder that faces the user;

said active antenna element exhibiting, in isolation, an antenna beam pattern that includes a first beam portion facing the user and a second beam portion facing away from the user;

said active antenna element for transducing the radio signals; and a parasitic antenna element positioned at the radio housing and diametrically opposite to said limited diametric portion of said cylinder and away from the user; said parasitic antenna element is electrically disconnected from and physically spaced apart from said active antenna element at a selected physical position such that said active antenna element is closer to the user than is said parasitic antenna element; and said parasitic antenna element for shifting said antenna beam pattern by reducing the gain of said first beam portion and concomitantly increasing the gain of said second beam portion in response to said positioning of said parasitic antenna element relative to said active antenna element.

2. The antenna assembly of claim 1 wherein:

said cylinder is of a selected lengthwise dimension; and said parasitic element is of a lengthwise dimension that is at least as great as said lengthwise dimension of said cylinder.

3. The antenna assembly of claim 2 wherein said active antenna element comprises a quarter-wave length, helical antenna.

4. The antenna assembly of claim 1 wherein said active antenna element comprises conductive paths printed upon a substrate to form a meandering line active antenna element.

5. The antenna assembly of claim 1 wherein:

the radio device comprises a multi-mode mobile phone operable to transceive radio signals within a first range of frequencies and within at least a second range of frequencies; and said active antenna element comprises a first elemental portion having antenna characteristics for transceiving radio signals within the first range of frequencies and a second elemental portion having antenna characteristics for transceiving radio signals within the at least second range of frequencies.

6. The antenna assembly of claim 1 wherein:

radio device comprises a mobile phone operable in a cellular communication system;

the radio housing at which the radio circuitry is housed includes a first side portion and a second side portion;

said first side portion facing toward the user when the mobile phone is operated by the user;

said second side portion facing away from the user when the mobile phone is operated by the user; and said active antenna element is positioned closer than said parasitic antenna element to said first side portion.

7. The antenna assembly of claim 1 wherein the radio circuitry comprises a radio transceiver operable by the user to effectuate voice communications there through, the voice communications being representative of oral utterances spoken by the user when the radio transceiver is positioned generally adjacent to the user.

8. The antenna assembly of claim 1 wherein the radio device comprises a mobile phone operable in a cellular communication system and wherein said active antenna element is of a type permitting the transducing of radio signals of cellular system frequencies.

9. An antenna assembly for transducing radio signals at a radio device that is operable in a radio communication system, the radio device having radio circuitry housed by a radio housing that is carriable by a user, said antenna assembly comprising:

an active antenna element positioned at the radio housing and electrically connected to the radio circuitry;

said active antenna element for transducing the radio signals;

said active antenna element exhibiting, in isolation, a transducing beam pattern having a first beam portion that faces the user and having a second beam portion that faces away from the user;

a parasitic antenna element positioned at the radio housing and physically spaced apart from said active antenna element in a parasitic relationship therewith such that said active antenna element is closer to the user than is said parasitic antenna element;

said parasitic antenna element is, further, physically separated from said active antenna element by a pre-selected separation distance wherein said active antenna element is, further, located on a semi-cylindrical portion of a cylinder having a given diameter, said given diameter is selected to achieve said pre-selected separation distance, and said parasitic antenna element is located on said semi-cylindrical portion of said cylinder that is diametrically opposite said active antenna element; and said parasitic antenna element for altering said transducing beam pattern by reducing the gain of said first beam portion and by concomitantly increasing the gain of said second beam portion in response to the positions of said parasitic antenna element and said active antenna element relative to the user.

* * * * *